United States Patent [19]

Nashan

[11] Patent Number: 5,039,379

[45] Date of Patent: Aug. 13, 1991

[54] DRY COOLING OF COKE

[75] Inventor: Gerd Nashan, Oberhausen, Fed. Rep. of Germany

[73] Assignee: Ruhrkohle AG, Essen, Fed. Rep. of Germany

[21] Appl. No.: 276,268

[22] Filed: Nov. 25, 1988

[30] Foreign Application Priority Data

Nov. 24, 1987 [DE] Fed. Rep. of Germany ..... 3739789

[51] Int. Cl.[5] ..... C10B 39/02

[52] U.S. Cl. ..... 201/7; 201/39; 202/226; 202/228

[58] Field of Search ..... 201/7, 39, 41; 202/226, 202/227, 228, 253, 262, 263, 230, 261; 414/212, 214, 215, 287, 303, 786; 241/23, 25

[56] References Cited

U.S. PATENT DOCUMENTS

| | | | |
|---|---|---|---|
| 1,593,698 | 7/1926 | Illingworth | 201/7 |
| 2,155,374 | 4/1939 | Hartog | 241/25 |
| 2,199,945 | 5/1940 | Archer et al. | 201/39 |
| 4,142,942 | 3/1979 | Calderon | 201/39 |
| 4,521,279 | 6/1985 | Lorenz et al. | 202/227 |
| 4,556,455 | 12/1985 | Weber et al. | 201/39 |
| 4,559,107 | 12/1985 | Lorenz et al. | 201/39 |
| 4,606,793 | 8/1986 | Petrovic et al. | 201/39 |
| 4,668,343 | 5/1987 | Nashan et al. | 201/39 |
| 4,701,243 | 10/1987 | Lorenz et al. | 201/3 |

*Primary Examiner*—Joye L. Woodard

*Attorney, Agent, or Firm*—Nils H. Ljungman & Associates

[57] ABSTRACT

A preferred method of dry cooling coke includes the steps of removing the coke from the coke oven, crushing the coke with a crushing device to increase a surface area thereof, transporting the coke after crushing to a dry cooling apparatus, and dry cooling the coke by the transfer of heat at the surface area which has been increased by the crushing.

5 Claims, 2 Drawing Sheets

DRY COOLING OF COKE

BACKGROUND OF THE INVENTION

1. Field of the Invention

This invention relates to a method of dry cooling coke and, more specifically, to such dry cooling which includes the crushing of the hot coke to small particles prior to the delivery to a cooling shaft or the like.

2. Description of the Prior Art

The dry cooling of coke is a process which is sometimes employed in contrast to the wet quenching of coke. In wet quenching, the coke is sprayed with water until it has undergone sufficient cooling. Wet quenching, of course, is a simple process, but one which produces considerable emissions. Additionally, the energy contained in the hot coke is lost during some wet quenching operation.

In contrast to wet quenching, dry-cooled coke contains no water, which unnecessarily consumes additional heat when, for example, the coke is used in a blast furnace. As a result of the improved dry cooling process, a higher coke strength and lower abrasion values are achieved.

The basic principle of dry cooling of coke is to directly extract the tangible heat of the coke by means of an inert cooling medium, and to obtain this heat in a readily-usable and efficient form, such as steam. The process typically includes the hot coke being removed from the coking chamber in buckets. The buckets are transported to a vertical cooling shaft and are emptied into the top of the shaft. As the coke is still falling through a sluice or lock onto the shaft containing the coke, it is cooled by a countercurrent or counterflow of inert gas. At the base of the cooling shaft, the cold coke is removed by means of a lock or sluice. The hot circulating gas exits the shaft in the upper portion and is conducted by way of a dust removal apparatus to the waste heat boiler for steam generation. The cooled gas is sucked in by the fan through another dust removal apparatus and is injected in the lower part of the shaft to cool the coke.

A more recent development provides that there is both a direct and indirect heat extraction from the coke by inert gas and by evaporator heating surfaces. The heat extracted in the inert gas circuit is used, on one hand, to heat water as it flows by the evaporator heating surfaces and, on the other hand, to superheat the steam. By means of these measures, the quantity of circulating gas is reduced, and thus the power consumption required to move it is also reduced. The coke heat to be extracted is completely converted into steam.

The determining factor for the efficiency of such installations is primarily the thermal transfer between the coke and the cooling surface and/or between the coke and the inert gas.

U.S. Pat. No. 4,668,343 discloses a method of dry cooling red-hot coke in a vessel having an antechamber with a small discharge leading to a vertically elongated cooling chamber which is of a larger dimension than the discharge and with both the cooling chamber and the antechamber having fluid cooling tubes in one or more walls and the ceiling thereof and also having cooling tube bank diverging downwardly from the discharge of the antechamber into the cooling chamber. The method comprises directing the red-hot coke to be cooled downwardly through the antechamber and into the cooling chamber so as to maintain a charge of coke in the cooling chamber to the conical charge cone of the cooling tubes adjacent the top of the cooling chamber which extends downwardly below the discharge, thereafter circulating a coolant through the cooling tubes to effect transfer of sensible heat from the coke to the fluid and directing a cooling gas from the bottom of the cooling chamber upwardly through the coke and above the entire area of the coke charging cone and then into an exhaust duct to one or more waste heat boilers.

U.S. Pat. No. 4,559,107 discloses a method of dry cooling coke using a coke transporting bucket which has a removable cover with an exhaust pipe extending from the interior of the bucket to an exterior exhaust connection and a cooling shaft for the coke comprises directing red hot coke into the bucket, covering the bucket with the cover and transporting the coke to the cooling shaft and connecting the exhaust pipe to the exhaust system while the bucket is in the shaft and emptying the bucket into the cooling shaft. The coke transporting bucket comprises a container having a bottom discharge which is closable by a flap and a removable cover which seats around the rim of the container to seal it. An exhaust pipe is carried by the cover and it extends into the interior thereof for removing gases from within the bucket and delivering them to an exterior connection which is connectable to an exhaust line. One or two exhaust pipes may be provided on the cover and each includes cover flaps which are biased into a closed position but which open to connect to the exhaust system when the cover is positioned to engage the exhaust line. The cover advantageously includes longitudinal girders which extend outwardly from each side or end of the cover and provide a means for supporting the cover when the bucket is lowered beneath a support structure to free the cover from the bucket.

U.S. Pat. Nos. 4,521,279; 4,556,455; 4,606,793; and 4,701,243 are also directed to and disclose various methods and equipment used to cool coke. All of the above-mentioned patents are incorporated herein by reference as if the entire contents thereof were fully set forth herein.

OBJECT OF THE INVENTION

It is a primary object of the invention to improve the thermal transfer of the heat from the coke in a dry cooling thereof.

SUMMARY OF THE INVENTION

Such an improvement in the thermal transfer is achieved by the present invention which includes the hot coke being crushed before the cooling process. Because of the reduced particle size, the coke has a surface area which is many times larger than would exist without the crushing. The surface area is increased by the same proportion for contact of the coke with the inert gas and for the contact of the coke with the evaporator heat surfaces. For the same cooling effort, the results become significantly more effective. This fact can be advantageously utilized to increase the quantitative flow of coke into the cooling shaft or to decrease the required volume of the coke dry cooling plant. There are also significant advantages for the structural support elements required for the cooling shaft. The cooling shaft need not be designed as massively, which is another economic advantage of the present invention.

A reduction in the amount of flow of hot coke makes it possible to significantly improve regulation of the installation. It is advantageous to first discharge the hot coke into a 2-way bunker having a system of discharge rolls. The 2-way bunker can be opened and closed by means of the discharge rolls and damming rakes. The rolls and rakes make possible a continuous, controlled transfer to the hot coke crusher where the coke is subsequently crushed, preferably, to an average particle size of 50 mm.

The bunker discharge capacity is regulated by changing the roll speed or the height of the coke layer. The rakes, rolls and hot crushers are water-cooled at the parts which are subjected to particularly high thermal stresses. The transfer points are connected to a dust removal system.

The hot crushers discharge the crushed coke to transport buckets. These buckets are offset from the crushers so that the crushers are protected from radiated heat by offset chutes which direct the crushed coke to the buckets. There is included means for measuring the level of the load in the buckets. At the same time, accessory rolls and rakes may be employed to limit the amount of material in the buckets.

During filling, each bucket is connected by means of a movable transfer apparatus to the discharge chute from the hot crusher, in a manner which prevents emissions. After the buckets have been filled to a specified level, the feed is discontinued. As the transfer apparatus is raised, the top of the bucket is closed. The bucket is then transferred to the cooling shaft and the hot coke is discharged in the manner described above.

Accordingly, a preferred method of dry cooling coke includes the steps of removing the coke from the coke oven and crushing the coke with a crushing device to increase a surface area thereof. Additional steps include transporting the coke after crushing to a dry cooling apparatus and dry cooling the coke by transfer of heat at the surface area which has been increased by the crushing.

DESCRIPTION OF THE PREFERRED EMBODIMENTS

Figure 1:
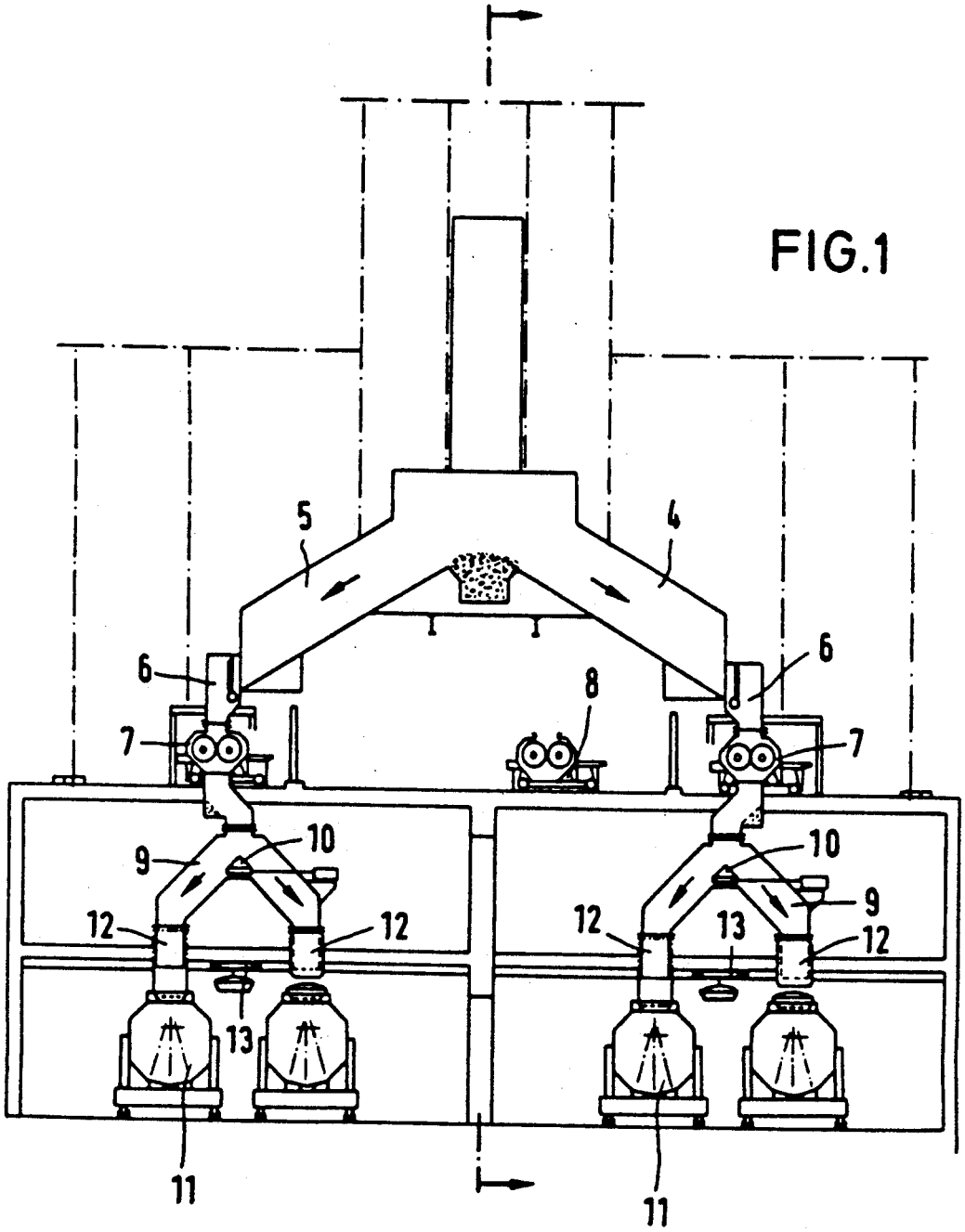
FIG. 1 is a schematic, elevational view of the preferred coke delivery and crushing equipment including various features of the invention.
Figure 2:
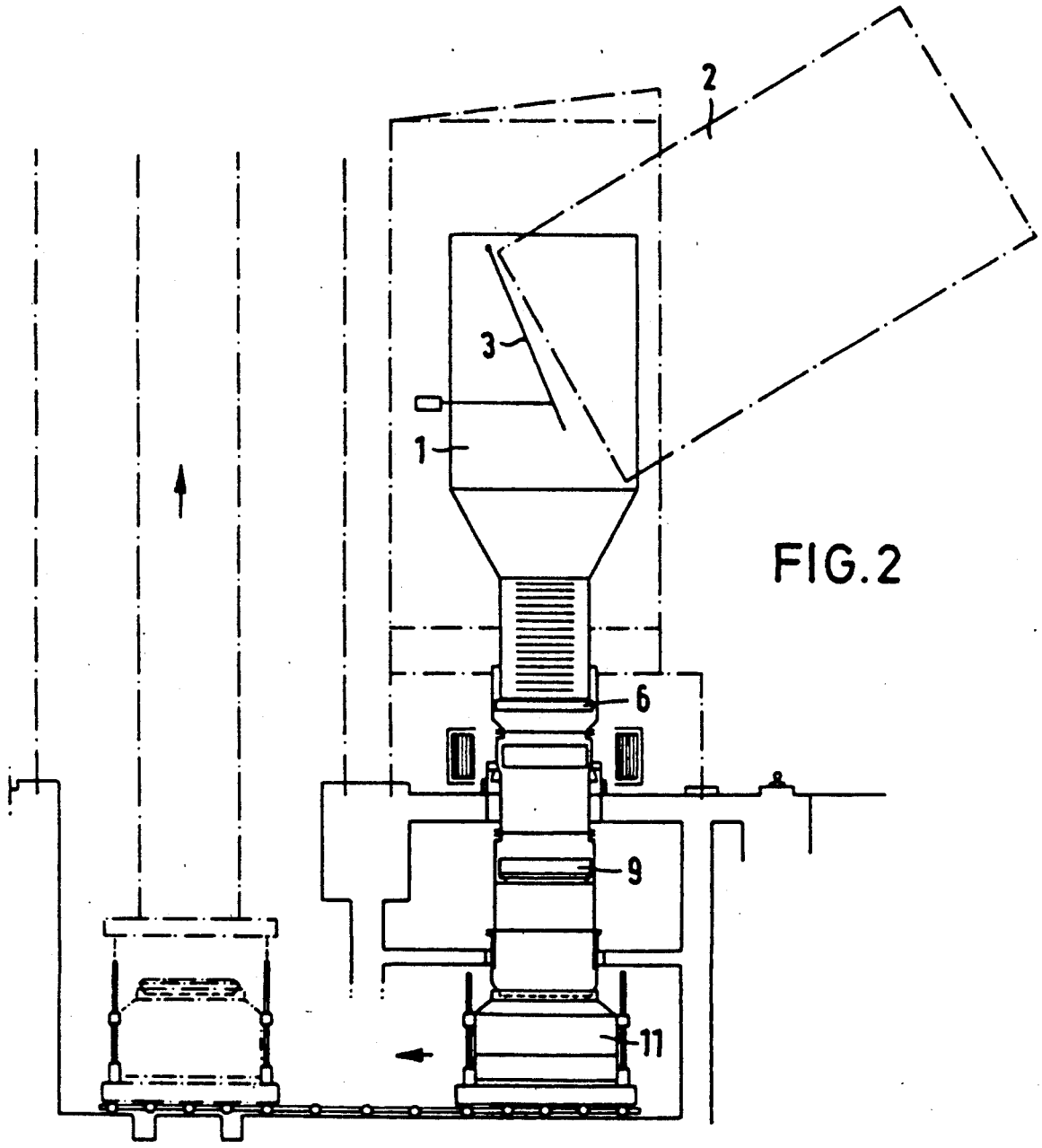
FIG. 2 is a schematic view of the equipment as seen along Line II—II of FIG. 1.

As seen in FIGS. 1 and 2, the hot coke coming from the coke oven (not shown) is discharged into the two-way bunker 1 by means of a transport cassette 2 represented by a dotted line. In the bunker 1, there is included an adjustable coke catching apparatus 3. The preferred adjustable coke catching apparatus 3 includes a shutter which can be adjustably activated by means of a power piston to control the dumping process. In other words, as the cassette 2 becomes emptier, the shutter widens to give increasing access for the hot coke being discharged into the bunker 1.

The coke supplied to the bunker 1 is uniformly distributed in the bunker 1 into the two bunker paths 4 and 5. At the end of each bunker path 4, 5, there is a system of discharge rolls 6 with damming rakes. Downstream of and below the discharge rolls 6 of each bunker path 4, 5, are hot crushers 7. The hot crushers 7 are advantageously designed for convenient removal so that each of the hot crushers 7 can be respectively replaced for service and/or repair with a back-up hot crusher 8 shown in a stored position in FIG. 1.

In the preferred hot crushers 7, the coke is crushed to an average particle size of about 50 mm. From the hot crusher 7, the coke travels into one of the chutes of a coke distributor 9 having a controllable distributor head 10. The distributor head 10 is controlled to selectively move horizontally to adjust the downward path of the coke to cause it to be introduced into one or the other of the chutes. Specifically, the coke is directed to the chute underneath which there is a bucket 11 for transporting the hot, crushed coke. During the introduction of the hot coke to the appropriate chute of the coke distributor 9, a transfer apparatus 12 at the outlet or discharge of the chute ensures that the charging process does not produce any emissions. After a bucket 11 is filled, the flow of coke is discontinued and the transfer apparatus 12 is retracted so that the bucket 11 can be moved. A cover or lid can then be placed over the bucket 11 by means of an apparatus 13, and the bucket thereby closed. The bucket 11 can then be moved, as shown by the direction arrows in FIG. 2, in order to deliver the crushed coke to the top of a cooling shaft (not shown) for subsequent dry cooling.

The invention as described hereinabove in the context of a preferred embodiment is not to be taken as limited to all of the provided details thereof, since modifications and variations thereof may be made without departing from the spirit and scope of the invention.

What is claimed is:

1. A method of dry cooling coke comprising the steps of:

removing said coke from a coke oven;

crushing said coke with crushing means to increase a surface area thereof;

delivering said coke after said crushing to bucket means for said transporting;

said delivering said coke including passing said coke through chute means to prevent radiant heat from said bucket means from directly heating said crushing means;

transporting said coke after said delivery to a dry cooling means; and dry cooling said coke by the transfer of heat at said surface area which has been increased by said crushing.

2. The method according to claim 1, wherein said passing said coke includes delivering said coke to said chute means, wherein;

said chute means comprises two chutes having respective bucket means located therebelow; and said delivering said coke includes passing said coke alternatively through said chutes.

3. The method according to claim 1, further including the step of sealing the outlet of said chute means to the opening of said bucket means during said delivering to prevent the production of emissions from said coke.

4. The method according to claim 3, further including the step of closing the opening of said bucket means after said bucket means is full of said coke prior to said transporting for said dry cooling.

5. A method of dry cooling coke comprising the steps of:

removing said coke from a coke oven;

separating said removed coke into two streams of coke;

regulating a flow of said streams of coke respectively to each of two crushing means at separate locations for crushing;

crushing said coke from each of said streams of coke with said respective crushing means to increase a surface area thereof; wherein, said crushing of said coke from each of said streams of coke produces an average particle size of about 50 mm;

delivering said coke from each of said streams of coke after said crushing to bucket means by passing said coke from each of said streams of coke through chute means to prevent radiant heat from said bucket means from directly heating said crushing means;

sealing an outlet of said chute means and an opening of said bucket means during said delivering to prevent the production of emissions from said coke from each of said streams of coke;

closing said bucket means after said bucket means is full of said coke from each of said streams of coke;

transporting of said coke filled bucket means to a dry cooling means;

discharging of said coke from each of said streams of coke out of said coke filled bucket means into said dry cooling means; and dry cooling said coke from each of said streams of coke by the transfer of heat at said surface area which has been increased by said crushing.

* * * * *

UNITED STATES PATENT AND TRADEMARK OFFICE

CERTIFICATE OF CORRECTION

PATENT NO. : 5,039,379

DATED : August 13, 1991

INVENTOR(S) : Gerd NASHAN

It is certified that error appears in the above-identified patent and that said Letters Patent is hereby corrected as shown below:

Column 4, line 55:

In Claim 2, line 7, delete "alternatively" and insert --alternately--.

Signed and Sealed this

Second Day of February, 1993

*Attest:*

STEPHEN G. KUNIN

*Attesting Officer*

*Acting Commissioner of Patents and Trademarks*